US005897039A

United States Patent [19]

Swenke

[11] Patent Number: 5,897,039

[45] Date of Patent: Apr. 27, 1999

[54] RETRACTABLE STRAP

[76] Inventor: J. Kevin Swenke, 23 Coventry Ct., Sugarland, Tex. 77479

[21] Appl. No.: 09/064,498

[22] Filed: Apr. 22, 1998

[51] Int. Cl.[6] ..... A45F 3/14; B65H 75/40

[52] U.S. Cl. ..... 224/162; 150/108; 224/258; 242/378.4; 242/384.7

[58] Field of Search ..... 242/378.4, 384.7; 224/162, 258; 150/108; 190/115

[56] References Cited

U.S. PATENT DOCUMENTS

| | | | |
|---|---|---|---|
| 2,769,475 | 11/1956 | Fisher | 150/33 |
| 2,845,155 | 7/1958 | Sneyd-Kynnersley | 190/115 |
| 3,198,300 | 8/1965 | Tuttle | 190/57 |
| 3,679,152 | 7/1972 | Stoffel | 242/107.4 |
| 3,707,109 | 12/1972 | Bohanec | 95/86 |
| 3,741,092 | 6/1973 | Bohanec | 95/86 |
| 4,301,977 | 11/1981 | Yang | 242/107 |
| 4,508,202 | 4/1985 | Siegert et al. | 190/115 |
| 4,658,999 | 4/1987 | Hilty | 224/202 |
| 4,978,044 | 12/1990 | Silver | 150/108 |
| 5,005,868 | 4/1991 | Stern et al. | 280/814 |
| 5,027,874 | 7/1991 | Gazzola | 150/108 |
| 5,072,867 | 12/1991 | Zingale | 224/162 |
| 5,294,029 | 3/1994 | Shimura et al. | 224/162 |
| 5,355,980 | 10/1994 | Hsieh | 190/115 |
| 5,492,285 | 2/1996 | Hamrick | 242/384.7 |
| 5,555,960 | 9/1996 | Bartsch | 190/115 |
| 5,560,458 | 10/1996 | Franklin et al. | 190/115 |
| 5,722,518 | 3/1998 | Aumasson | 190/115 |

*Primary Examiner*—Stephen P. Garbe
*Attorney, Agent, or Firm*—Browning Bushman

[57] ABSTRACT

A retractable strap that may be attached to a variety of different transportable objects that includes a flexible strap having first and second ends and a first and second retractor, each first and second retractor having an attachment end for attaching the object and a strap end for receipt of a respective first and second end of the flexible strap such that the first and second retractor enable adjustment of the flexible strap from the first and second ends.

10 Claims, 3 Drawing Sheets

FIG. 1
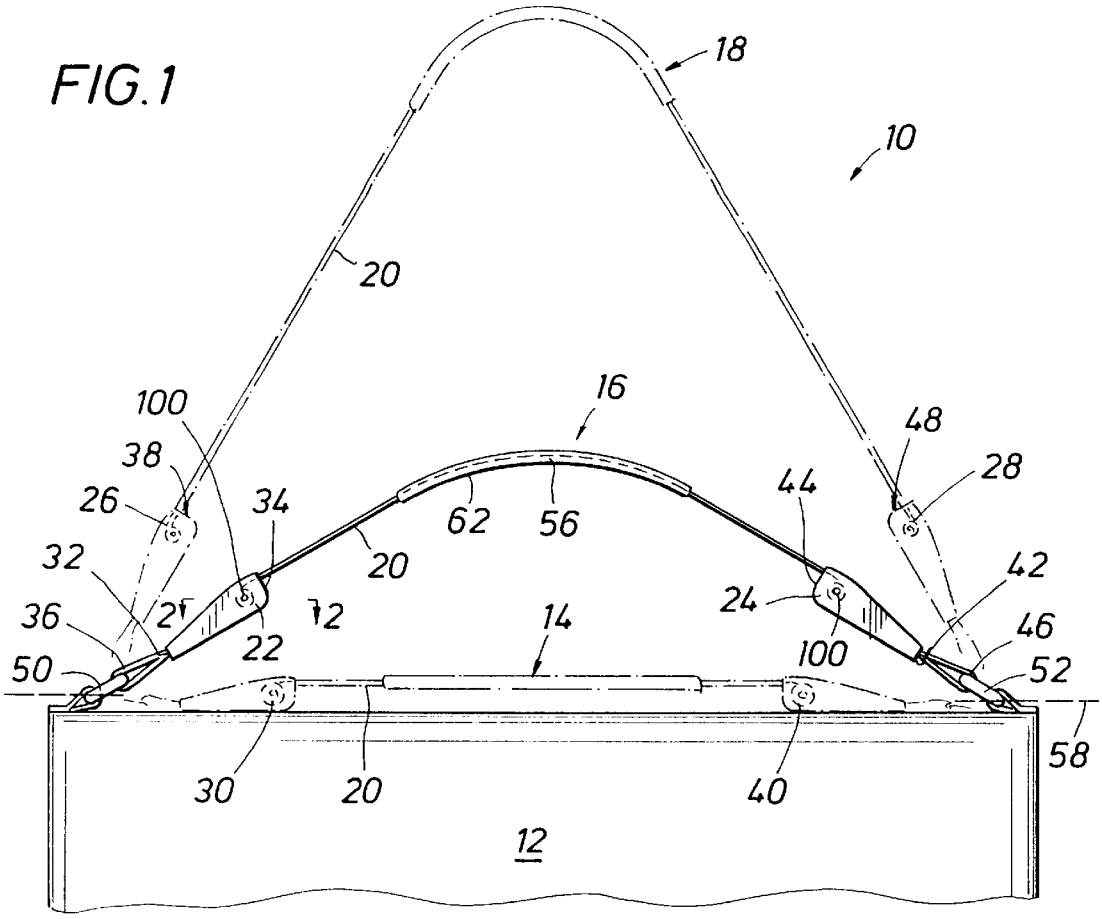
FIG. 2
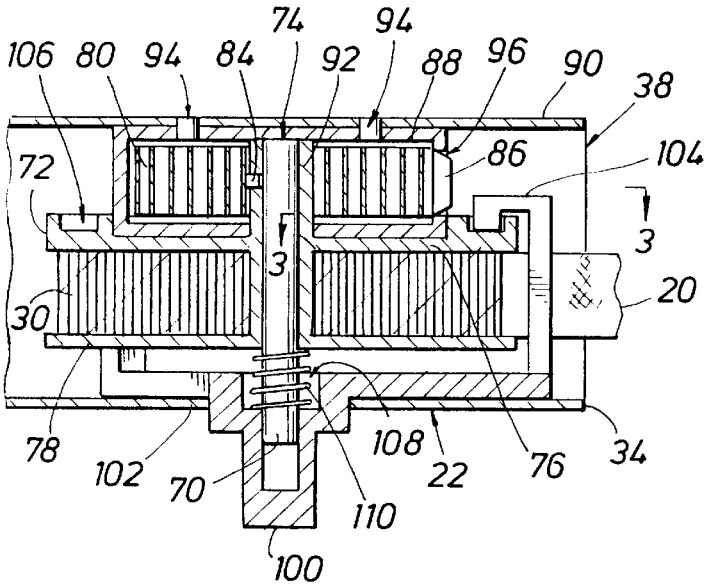
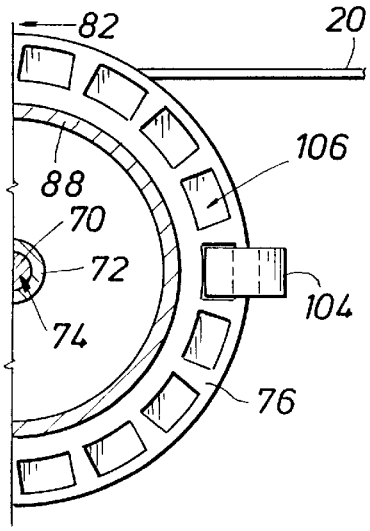
FIG. 3

RETRACTABLE STRAP

FIELD OF THE INVENTION

This invention relates to a retractable strap that may be attached to various transportable objects and is fully retractable when not in use. In particular, the present invention includes a flexible strap and a retractor connected to each end of the flexible strap such that the retractable strap is adjustable at either end for attaching a variety of transportable objects.

BACKGROUND OF THE INVENTION

Generally any transportable object such as a briefcase or hand bag is equipped with a handle so that it may be carried by hand. In some cases however, the object may become too heavy to be carried by the handle alone for a long period of time or it may prove inconvenient when the person carrying it wishes to use both hands for something else. For these reasons, a suspending strap or shoulder strap is ordinarily attached to the object.

A shoulder strap attached to a moveable object is designed so that its length may be varied by an adjusting member such as a buckle. In other words, the length of the shoulder strap must be adjusted to accommodate the person using the bag which can become inconvenient. Additionally, the length of the strap may cause it to hang loose from the object and/or become caught on another protruding object. Thus, the shoulder strap may become dirty when the object is put on the ground, resulting in stains to the clothes of the person carrying the object. Moreover, the shoulder strap is in the way when it is not being used, and may become hazardous, leading to an accident.

Some devices have attempted to eliminate the foregoing problems by means of a hook fixture or the like, which allows the shoulder strap to be attached or detached from the object. However, these devices are not attached to or detached from the associated object each time it becomes necessary or unnecessary. It is usually while the object is being carried that the shoulder strap becomes necessary or unnecessary. In other words, the shoulder strap is not usually detached even if it becomes unnecessary. These conventional devices are inconvenient in that, when the strap becomes unnecessary, the portion of the strap hanging from the object must be secured in the object or gripped together with the handle. Accordingly, these devices are not useful in eliminating the foregoing problems and inconveniences.

In view of this, a variety of strap lodging devices have been proposed in which the strap can be withdrawn into the object or extracted therefrom, depending upon whether the strap is used regularly. These strap lodging devices may be categorized according to two types of locking mechanism: (1) the strap itself is press-locked to prevent it from being extracted or withdrawn inadvertently; or (2) a ratchet mechanism allows the winder of the strap to rotate in one direction only. Either type of conventional strap lodging device must be designed and manufactured into the associated object making it impossible to use on a variety of different objects. Moreover, these conventional strap lodging devices deprive the associated object of its effective space. In some cases, objects such as a video camera offer little or no space at all for mounting the strap lodging device.

Other conventional strap lodging devices such as U.S. Pat. No. 3,198,300 to Tuttle and U.S. Pat. No. 5,294,029 to Shimura, et al attempt to address the problems associated with a strap lodging device that must be manufactured into the object. For example, the device described in the '300 patent to Tuttle is a retractable strap lodging device that may be disposed in either the portable object itself or as a separate (handle) assembly. Although the device described by the '300 patent to Tuttle addresses the use of a pair of spools which act to retract the strap from either end, the Tuttle device is limited by the dimensions of the object since it must either be manufactured into the object itself or constructed as a handle for a specific object. Similarly, the strap lodging device described by the '029 patent to Shimura et al is similarly limited by the size of the object for which it is intended since the object must be large enough to accommodate the attachment means of the device. Moreover, the device described by the '029 patent to Shimura et al incorporates a single retraction mechanism limiting the adjustability of the device relative to the object, which can cause uneven wear along the length of the strap.

Accordingly, there is a specific need for a retractable strap that is sufficiently compact and lightweight to carry on a person or store in an object such as a handbag, yet is adjustable at either end to accommodate a variety of different transportable objects.

SUMMARY OF THE INVENTION

It is a primary object of the present invention to provide a retractable strap that is compact, lightweight and capable of being adjusted to accommodate a variety of different objects such as handbags, golfbags and the like.

It is an object of the present invention to provide a retractable strap that is inexpensive to manufacture and easy to use.

It is still another object of the present invention to provide a retractable strap that includes a first retractor and a second retractor attached to the respective ends of a flexible strap for enabling adjustment of a portion of the flexible strap retractably housed within each retractor such that the first retractor is moveable relative to the second retractor.

It is a feature of the present invention to provide the retractable strap with a first retractor and a second retractor attached to respective ends of a flexible strap such that a portion and another portion of the flexible strap may be releasably secured within a respective first and second retractor.

It is another feature of the present invention to provide the retractable strap with a flexible strap that is fully retractable when not in use.

It is another feature of the present invention to provide the retractable strap with a first retractor and a second retractor attached to respective ends of a flexible strap such that a portion and another portion of the flexible strap retractably housed within a respective first and second retractor may be adjusted upon release of a retractor key.

It is still another feature of the present invention to provide the retractable strap with a first retractor and a second retractor attached to respective ends of a flexible strap such that a portion and another portion of the flexible strap releasably secured within a respective first and second retractor may be freely adjusted in a first direction and may be adjusted in a second direction upon release of a retractor key.

It is yet another feature of the present invention to provide the retractable strap with a first retractor and a second retractor attached to respective ends of a flexible strap such that a portion and another portion of the flexible strap releasably secured within a respective first and second retractor may be proportionately adjusted relative to one another.

It is yet another feature of the present invention to provide the retractable strap with a flexible strap having a contact portion that remains fixedly positioned between respective ends of the flexible strap for preventing uneven wear when the portion and another portion releasably secured within a respective first and second retractor are proportionately adjusted.

It is an advantage of the present invention to provide the retractable strap with a flexible strap and a pad that is moveably attached to the flexible strap.

It is another advantage of the present invention to provide the retractable strap with a flexible strap and a pad that remains fixedly positioned between the first end and the second end of the flexible strap when the portion and another portion releasably secured within a first and second retractor are proportionately adjusted.

It is still another advantage of the present invention to provide a retractable strap with a pair of quick release clasps attached to a respective first and second retractor in order that the retractable strap may be releasably secured to an object.

The present invention is directed to a retractable strap comprising a flexible strap, a first retractor and a second retractor. The flexible strap has a first end and a second end. The first retractor houses a portion of the flexible strap and has an attachment end and a strap end. The attachment end of the first retractor includes a clasp for releasably attaching the first retractor to a transportable object such as a handbag, briefcase or the like. The strap end of the first retractor includes an opening for receipt of the first end of the flexible strap such that the portion of the flexible strap is releasably secured within the first retractor.

The second retractor houses another portion of the flexible strap and has an attachment end and a strap end. The attachment end includes a clasp for releasably attaching the second retractor to the object. The strap end of the second retractor includes an opening for receipt of the second end of the flexible strap such that another portion of the flexible strap is releasably secured within the second retractor. The first and second retractor therefore, enable adjustment of a respective flexible strap portion and another portion such that the first retractor is moveable relative to the second retractor. This enables adjustment of the flexible strap between the first and second retractor such that the retractable strap may be attached to a variety of different objects.

Each first and second retractor comprises a rotatable shaft and a spool secured to the shaft. The spool has a centrally disposed longitudinal opening for receipt of the shaft, a first flange and a second flange in spaced apart relationship. Each first and second retractor also include a spring for biasing the spool to rotate in a first direction. Each spring has a first end and a second end wherein the first end is operatively secured to the shaft and the second end is operatively secured within a respective first and second retractor. A respective first and second end of the flexible strap are fixedly secured to a respective spool for each first and second retractor between the first and second flange such that the portion and another portion of the flexible strap are releasably secured within a respective first and second retractor.

In a preferred embodiment, a plurality of equidistantly spaced annular recesses are formed in a surface of at least one of the first and second flanges. A key is releasably secured within at least one of the plurality of annular recesses such that rotation of the spool in at least a first direction is prevented during use of the retractable strap. Alternatively, a key may be releasably secured within at least one of the plurality of annular recesses such that rotation of the spool is prevented in either direction.

The portion of the flexible strap releasably secured within the first retractor may be proportionately adjusted relative to another portion of the flexible strap releasably secured in the second retractor such that the adjusted portion and another portion are equal. Alternatively, a portion of the flexible strap releasably secured within a first retractor may be proportionately adjusted relative to another portion of the flexible strap releasably secured within the second retractor such that the adjusted portion and the another portion are unequal. The flexible strap includes a contact portion fixedly positioned between the first end and the second end of the flexible strap when the portion and another portion of the flexible strap are proportionately adjusted. The contact portion becomes moveable between the first and second end of the flexible strap when the portion and another portion are disproportionately adjusted.

In one embodiment, a pad may be attached to the flexible strap between the first end and the second end such that the pad may be slidably adjusted on the flexible strap between the first and second retractor. In another embodiment, a pad may be fixedly attached to the flexible strap between the first and second retractor such that the pad remains fixed relative to the first end and the second end of the flexible strap when the portion and the another portion of the flexible strap are proportionately adjusted.

The above and other objects, advantages and features of the present invention will become apparent from the following detailed description wherein reference is made to the figures and accompanying drawings.

Brief Description of the Drawings

FIG. 1 is an elevational view of the retractable strap shown attached to a briefcase in a first retracted position, a second partially retracted position and a third fully extended position wherein the first and third positions are shown in phantom.

FIG. 2 is a cross-section of one embodiment of the retractor shown in FIG. 1 taken along line 2—2.

FIG. 3 is a partial side view of the retractor spool and key shown in FIG. 2 taken along line 3—3.

DETAILED DESCRIPTION OF THE PREFERRED EMBODIMENTS

Figure 4:
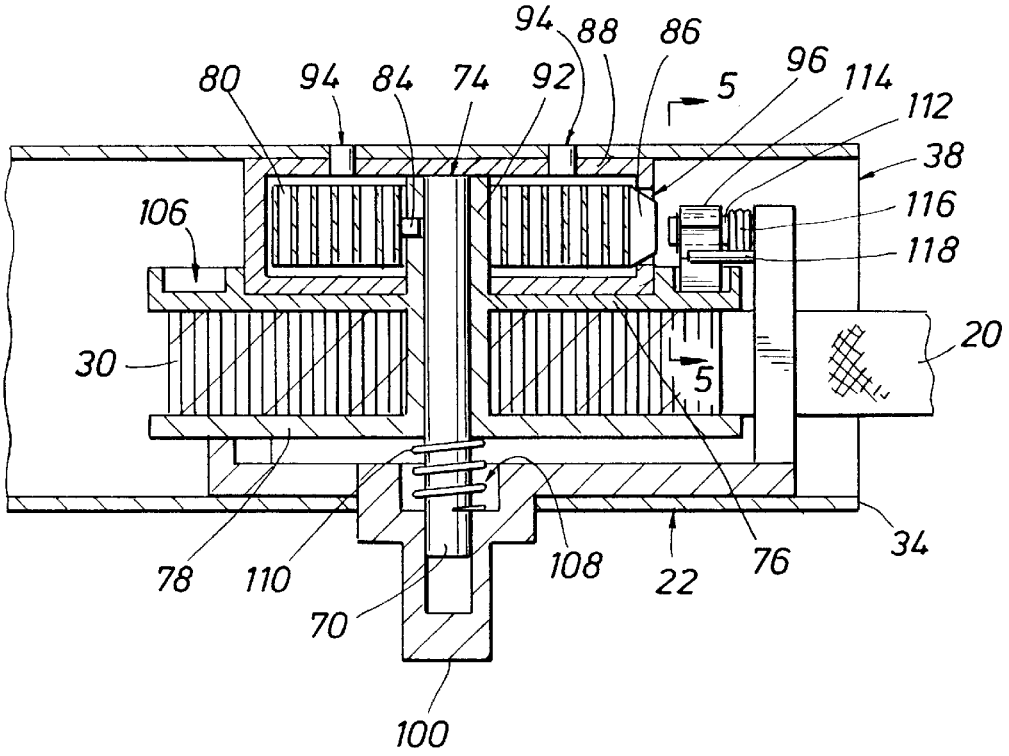
FIG. 4 is a cross-sectional view of another embodiment of the retractor shown in FIG. 1 taken along line 2—2.

In FIG. 1, an elevational view of the retractable strap 10 is shown attached to a briefcase 12 in a first retracted position 14, a second partially retracted position 16 and a third fully extended position 18. The first and third positions 14 and 18 are shown in phantom. The retractable strap 10 comprises a flexible strap 20, a first retractor 22 and a second retractor 24. The flexible strap 20 has a first end 26 and a second end 28. The first retractor 22 houses a portion 30 of the flexible strap 20 and has an attachment end 32 and a strap end 34. The attachment end 32 of the first retractor 22 includes a clasp 36 for releasably attaching the first retractor 22 to an object such as the briefcase 12. The strap end 34 of the first retractor 22 includes an opening 38 for receipt of the first end 26 of the flexible strap 20 such that the portion 30 of the flexible strap 20 is releasably secured within the first retractor as more particularly shown in reference to FIG. 2.

The second retractor 24 houses another portion 40 of the flexible strap 20 and has an attachment end 42 and a strap end 44. The attachment end 42 includes a clasp 46 for releasably attaching the second retractor 24 to an object such as the briefcase 12. The strap end 44 of the second retractor 24 includes an opening 48 for receipt of the second end 28 of the flexible strap 20 such that another portion 40 of the flexible strap 20 is releasably secured within the second retractor 24. The first and second retractor 22 and 24 enable adjustment of a respective flexible strap portion 30 and another portion 40 such that the first retractor 22 is moveable relative to the second retractor 24 prior to attaching the object or briefcase 12.

Since most objects such as the briefcase 12 have at least two points of attachment (i.e., first and second rings 50 and 52), the retractable strap 10 may be used to support and carry such objects. Moreover, since the first retractor 22 is moveable relative to the second retractor 24, the retractable strap 10 may be adjusted to fit just about any object regardless of where the two points of attachment are located on the object. Furthermore, the space needed for attachment of each first and second retractor 22 and 24 is minimized by use of the clasps 36 and 46.

Still referring to FIG. 1, the retractable strap 10 may be adjusted to a first retracted position 14 such that the flexible strap 20 lies closely adjacent the briefcase 12 and thus, out of the way when the retractable strap 10 is not needed. Depending upon the size of the person using the retractable strap 10 to carry the object or briefcase 12, the flexible strap 20 may be adjustably lengthened to a second partially retracted position 16, a fully extended position 18 or any other desired position between the fully extended and first retracted positions 18 and 14, respectively.

Figure 7:
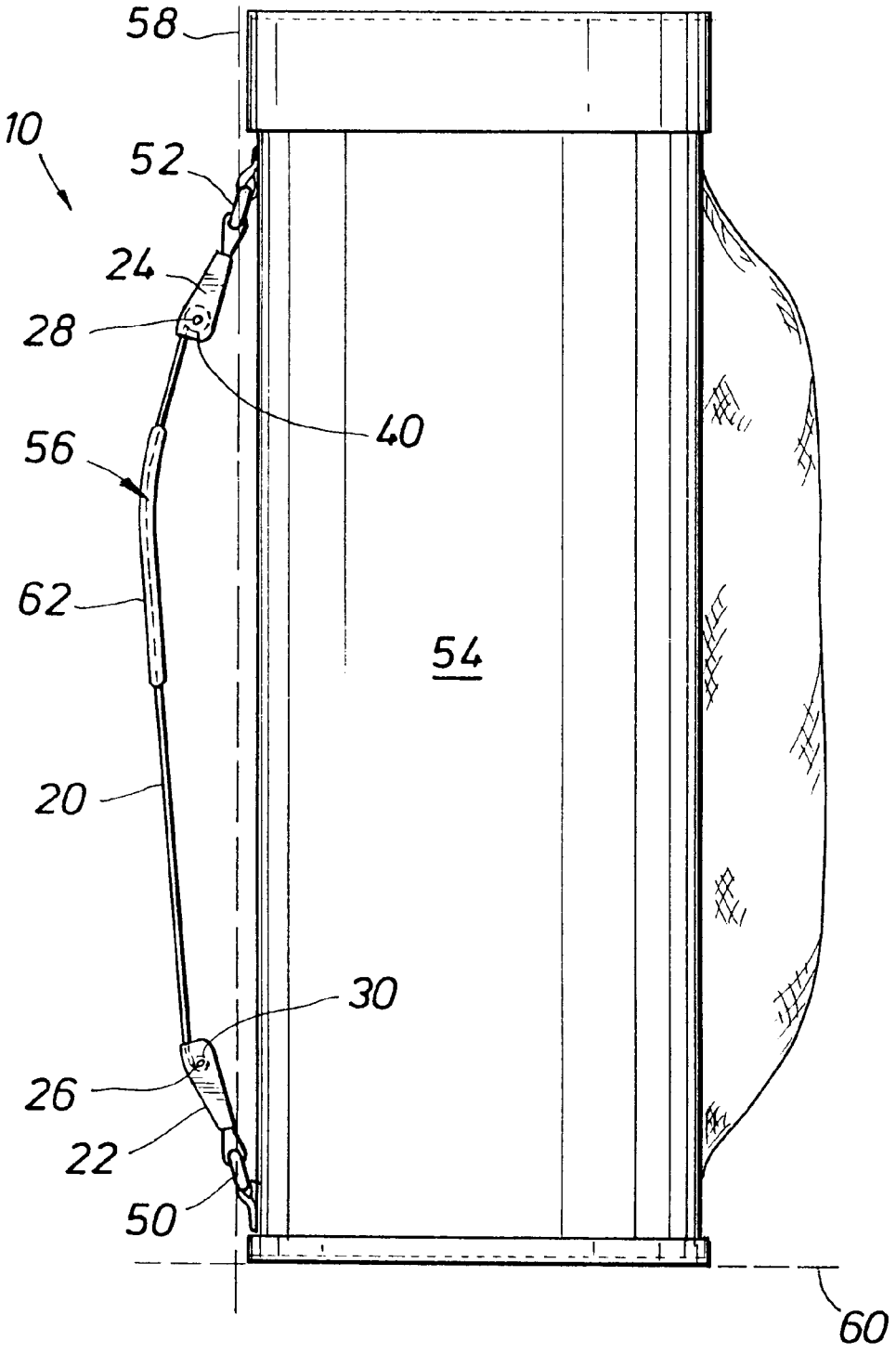
FIG. 7 is an elevational view of the retractable strap shown attached to a golf bag.

Referring now to FIGS. 1 and 7, additional advantages of the retractable strap 10 are seen. The portion 30 of the flexible strap 20 releasably secured within the first retractor 22 may be proportionately adjusted relative to the another portion 40 of the flexible strap 20 releasably secured within the second retractor 24 such that the portion 30 and another portion 40 are equal as shown in FIG. 1. Alternatively, the portion 30 of the flexible strap 20 releasably secured within the first retractor 22 may be proportionately adjusted relative to the another portion 40 of the flexible strap 20 releasably secured within a second retractor 24 such that the portion 30 and another portion 40 are unequal as shown in FIG. 7.

The retractable strap 10 may thus be attached to different objects such as the golf bag 54 in FIG. 7 which are typically carried in various positions causing uneven wear along the flexible strap 20. The retractable strap 10 alleviates uneven wear in the vicinity of contact along the flexible strap 20 by providing the flexible strap 20 with a contact portion 56 that remains fixedly positioned between the first end 26 and the second end 28 of the flexible strap 20 when the portion 30 and another portion 40 are proportionately adjusted. The contact portion 56 defines an area of the flexible strap 56 that is normally in contact with the person carrying the object or golf bag 54. Thus, the contact portion 56 is subjected to forces causing wear to the flexible strap 20 in this area.

In FIG. 7, the contact portion 56 is closer to the second retractor 24 than the first retractor 22 because the golf bag 54 has first and second attachment points or rings 50 and 52 which lie in a first plane 58 that intersects a second plane 60 defined by a ground surface when the object or golf bag 54 is carried. In FIG. 1, contact portion 56 is positioned equidistantly between the first and second retractor 22 and 24 and the first and second end 26 and 28 of the flexible strap 20 because the first and second attachment points or rings 50 and 52 lie in a plane 58 that is parallel to a plane defined by a ground surface (not shown). Regardless of the position or size of the object to be carried such as a briefcase 12 (FIG. 1) or a golf bag 54 (FIG. 7), the contact portion 56 remains fixedly positioned between the first and second end 26 and 28 of the flexible strap 20 preventing uneven wear and tear along the flexible strap 20 encountered by conventional strap lodging devices. In other words, the contact portion 56 remains fixedly positioned between the first and second end 26 and 28 of the flexible strap 20 when the first plane 58 necessarily intersects the second plane 60 because the first and second retractor 22 and 24 enable the portion 30 and another portion 40 to be proportionately adjusted.

In order to alleviate wear on the contact portion 56, a pad 62 is attached to the flexible strap 20 between the first and second end 26 and 28. The pad 62 may be slidably adjusted on the flexible strap 20 between the first and second retractor 22 and 24 as needed. Alternatively, the pad 62 is fixedly positioned on the flexible strap 20 between the first and second retractor 22 and 24 when the portion 30 and another portion 40 of the flexible strap 20 are proportionately adjusted.

Reference is now made to FIG. 2 wherein each first and second retractor 22 and 24 are similarly constructed and therefore, a cross-sectional view of one embodiment of the first retractor 22 in FIG. 1 is shown taken along line 2—2. Each first and second retractor 22 and 24 comprise a rotatable shaft 70 secured within a respective first and second retractor 22 and 24, and a spool 72 connected to the shaft 70. The spool 72 has a centrally disposed longitudinal opening 74 for receipt of the shaft 70, a first flange 76 and a second flange 78 in spaced apart relationship. Each first and second retractor 22 and 24 also include a spring 80 for biasing a spool 72 to rotate in a first direction 82. Each spring 80 has a first end 84 and a second end 86 wherein the first end 84 is fixedly secured to the spool 72 and the second end 86 is operatively secured to a respective first and second retractor 22 and 24. For stability and convenience, a spring housing 88 may be positioned between a first side wall 90 and the first flange 76 for housing the spring 80 and a protruding portion 92 of the spool 72 which is attached to the first end of the spring 84. The spring housing 88 and first side wall 90 contain a plurality of corresponding openings 94 through which a screw or bolt (not shown) may be positioned to secure the spring housing 88 in place. Alternatively, the spool 72 may also include a housing (not shown) for the spring 80 to conserve space in each first and second retractor 22 and 24. Each first and second end 26 and 28 of the flexible strap 20 are fixedly secured to a respective spool between the first and second flange 76 and 78 such that the portion 30 and another portion 40 of the flexible strap 20 are releasably secured within a respective first and second retractor 22 and 24.

With reference now to FIGS. 2 and 3, the portion 30 and another portion 40 of the flexible strap 20 may be proportionately adjusted by depressing a key 100 that protrudes through a second side wall 102 of each first and second retractor 22 and 24. The key 100 includes a key arm 104 that may be releasably secured within at least one of a plurality of equidistantly spaced annular recesses 106 formed in the surface of the first flange 76. When the key arm 104 is releasably secured within at least one of the plurality of annular recesses 106, rotation of the spool 72 is prevented. Conversely, rotation of the spool 72 is enabled when the key arm 104 is removed from at least one of the plurality of annular recesses 106.

The key 100 includes a stepped bore 108 for receipt of a portion of the shaft 70 and activating spring 110. The activating spring 110 is positioned around a portion of the shaft 70 extending into the stepped bore 108 and biases the key arm 104 into at least one of the plurality of annular recesses such that the spool 72 is placed in a locked position preventing rotation of the spool 72. In another embodiment (not shown), the key arm 104 may be releasably secured within a plurality of equidistantly spaced annular recesses formed a surface of the second flange 78 such that the key 100 releases the spool 72 to freely rotate when the key 100 is pulled.

The incremental spacing of the plurality of annular recesses 106 determines the degree to which the flexible strap 20 may be adjusted. As the plurality of annular recesses 106 are spaced closer together, the flexible strap 20 may be adjusted between a greater number of positions. For example, retractable strap 10 may be secured in positions between the first position 14, second position 16 and third position 18 as shown in FIG. 1, dependent upon the incremental spacing between the plurality of annular recesses 106.

Reference is now made to FIG. 4 wherein each first and second retractor 22 and 24 are similarly constructed and therefore, a cross-sectional view of a preferred embodiment of the first retractor 22 in FIG. 1 is shown taken along line 2—2. By comparison, the first retractor 22 depicted in FIG. 2 is similar to the first retractor 22 depicted in FIG. 4 with some notable differences. For example, the key 100 includes a key arm 112 and moveable finger 114 rotably secured to the key arm 112 such that the moveable finger 114 is positioned over at least one of a plurality of the equidistantly spaced annular recesses 106. A spring 116 is attached at one end (not shown) to the key arm 112, and is attached at another end 113 to the moveable finger 114. The spring 116 biases the moveable finger 114 into at least one of the plurality of annular recesses 106 as shown more particularly in reference to FIG. 5 which is a cross-sectional view of the spool 72 and key 100 in a first locked position as shown in FIG. 4 taken along line 5—5.

Figure 5:
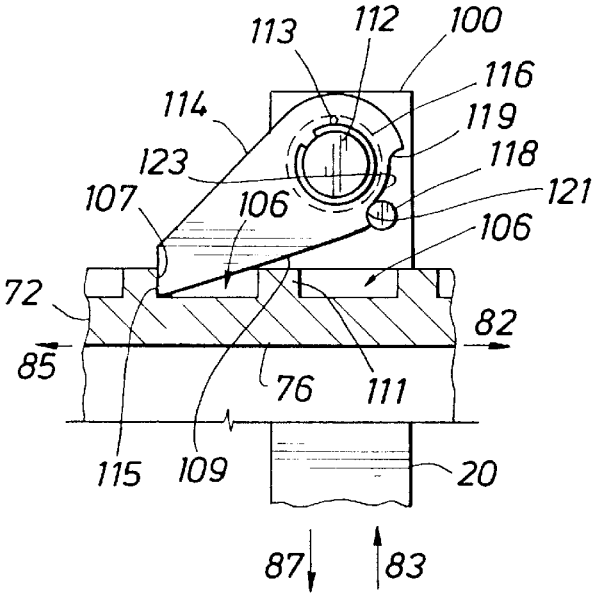
FIG. 5 is a cross-sectional view of the retractor spool and key in a first locked position shown in FIG. 4 taken along line 5—5.

A spring 80 biases the spool 72 to rotate in a first direction as indicated by arrow 82 in FIG. 5. However, movement of the spool 72 in the first direction 82 is prevented when the moveable finger 114 is biased into at least one of the plurality of annular recesses 106. A stop shoulder 115 on the moveable finger 114 abuts against a side wall 107 of the annular recess 106, preventing rotation of the spool 72 in at least the first direction 82. Although, retraction of the flexible strap 20 in a direction indicated by arrow 83 is prevented, rotation of the spool 72 in a second direction indicated by arrow 85 is permitted when an inclined surface 109 of the moveable finger 114 passes freely over a plurality of walls 111 each separating a respective annular recess 106. Accordingly, the moveable finger 114 is designed to enable the flexible strap 20 to be withdrawn in a second direction 87 to a desired length and then releasably secured when the moveable finger 114 is biased into at least one of the plurality of annular recesses 106, preventing further retraction of the flexible strap 20 in direction 83. This embodiment permits quick and easy withdrawal of the flexible strap 20 to a desired length while maintaining the flexible strap 20 in a releasably secured position once it has been withdrawn to its desired length.

Figure 6:
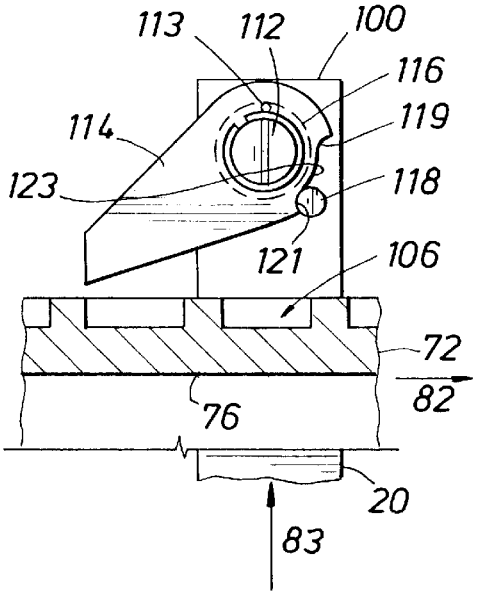
FIG. 6 is a cross-sectional view of the retractor spool and key shown in FIG. 5 but in a second released position.

With reference now to FIG. 6, a cross-sectional view of the spool 72 and key 100 are shown from FIG. 5 but in a second released position. Here, the moveable finger 114 is released from the locked position shown in FIG. 5 by depressing the key 100. The key 100 is held in the first locked position shown in FIG. 5 by an activating spring 110 positioned around a portion of the shaft 70 which lies in a stepped bore 108 of the key 100. Thus, the activating spring 110 biases the key 100 into the first locked position until the key 100 is depressed, releasing the moveable member 114 from at least one of the plurality of annular recesses 106 as shown in FIG. 6. Once the moveable finger 114 is released from one of the plurality of recesses 106, the spool 72 is free to rotate in the first direction 82 causing the flexible strap 20 to retract in a corresponding direction 83. Although the moveable finger 114 is biased towards the first flange 76, a pin member 118 stops the moveable finger 114 when the pin member 118 engages a second shoulder 121 of a groove 123 formed in a surface of the moveable finger 114. The pin 118 enables limited rotation of the moveable finger 114 while in the first locked position shown in FIG. 5 such that the moveable finger 114 may be forced out of one of the plurality of annular recesses 106 when the spool 72 travels in direction 85 before the pin member 118 abuts a first shoulder 119 of the groove 123.

Accordingly, a first and second retractor 22 and 24 constructed in accordance with the embodiment described in reference to FIGS. 4–6 enables the flexible strap 20 to be freely withdrawn to a desired length and then releasably secured until the key 100 is depressed on each first and second retractor 22 and 24. In either embodiment described in reference to FIGS. 2 or 4, the portion 30 and another portion 40 of the flexible strap 20 may be proportionately adjusted in equal or unequal lengths to facilitate attachment of the retractable strap 10 to a variety of different transportable objects and prevent uneven wear of the flexible strap during transportation of the desired object. The portion 30 and another portion 40 of the flexible strap 20 may also be disproportionately adjusted as needed.

While the foregoing embodiments of a retractable strap have been shown and described, it is to be understood that the invention is not limited thereto and protection is sought to the broadest extent the prior art allows and additional modifications may be made to the invention without departing from the spirit and scope thereof.

What is claimed is:

1. A retractable strap comprising:

a flexible strap having a first end and a second end;

a first retractor for housing a portion of the flexible strap, the first retractor having an attachment end and a strap end, the attachment end having a clasp for releasably attaching the first retractor to an object, the strap end having an opening for receipt of the first end of the flexible strap such that the portion of the flexible strap is releasably secured within the first retractor;

a second retractor for housing another portion of the flexible strap, the second retractor having an attachment end and a strap end, the attachment end having a clasp for releasably attaching the second retractor to the object, the strap end having an opening for receipt of the second end of the flexible strap such that the another portion of the flexible strap is releasably secured within the second retractor; and the first and second retractor enabling adjustment of a respective flexible strap portion and another portion such that the first retractor is moveable relative to the second retractor.

2. The retractable strap of claim 1, wherein each first and second retractor comprises:

a rotatable shaft;

a spool secured to the shaft, the spool having a centrally disposed longitudinal opening for receipt of the shaft, a first flange and a second flange in spaced apart relationship;

a spring for biasing the spool to rotate in a first direction, the spring having a first end and a second end, the first end being secured to the spool and the second end being operatively secured to a respective first and second retractor;

the first and second end of the flexible strap being fixedly secured to a respective spool between the first and second flange such that the portion and another portion of the flexible strap are releasably secured within a respective first and second retractor.

3. The retractable strap of claim 2, further comprising:

a plurality of equidistantly spaced annular recesses formed in a surface of at least one of the first and second flanges; and a key releasably secured within at least one of the plurality of annular recesses such that rotation of the spool is prevented.

4. The retractable strap of claim 2, further comprising:

a plurality of equidistantly spaced annular recesses formed in a surface of at least one of the first and second flanges; and a key releasably secured within at least one of the plurality of annular recesses such that rotation of the spool in at least a first direction is prevented.

5. The retractable strap of claim 1, further comprising:

a pad attached to the flexible strap between the first end and the second end such that the pad may be slidably adjusted on the flexible strap between the first and second retractor.

6. The retractable strap of claim 1, wherein the portion of the flexible strap releasably secured within the first retractor may be proportionately adjusted relative to the another portion of the flexible strap releasably secured within the second retractor such that the adjusted portion and another portion are unequal.

7. The retractable strap of claim 1, wherein the portion of the flexible strap releasably secured within the first retractor may be proportionately adjusted relative to the another portion of the flexible strap releasably secured within the second retractor such that the adjusted portion and another portion are equal.

8. The retractable strap of claim 7, wherein the flexible strap comprises:

a contact portion fixedly positioned between the first end and the second end for preventing uneven wear on the flexible strap when the portion and another portion of the flexible strap are proportionately adjusted.

9. The retractable strap of claim 7, further comprising:

a pad fixedly attached to the flexible strap between the first and second retractor.

10. The retractable strap of claim 9, wherein the pad remains fixedly positioned between the first end and the second end when the portion and another portion of the flexible strap are proportionately adjusted.

* * * * *